United States Patent [19]

Patrick

[11] 4,288,155

[45] Sep. 8, 1981

[54] VARIABLE VOLUME DIAZOTYPE DEVELOPING APPARATUS AND METHOD

[75] Inventor: Henry W. Patrick, Raleigh, N.C.

[73] Assignee: Diazit Company, Inc., Youngsville, N.C.

[21] Appl. No.: 70,795

[22] Filed: Aug. 29, 1979

[51] Int. Cl.[3] ..... G03D 7/00

[52] U.S. Cl. ..... 354/300; 354/324; 34/37; 430/150; 138/30

[58] Field of Search ..... 354/300, 318, 299, 324; 355/27, 100, 106; 34/36, 37, 51, 155, 219, 220; 430/150; 138/30; 137/207; 220/85 B

[56] References Cited

U.S. PATENT DOCUMENTS

| | | | |
|---|---|---|---|
| 3,704,661 | 12/1972 | Johnson et al. | 354/318 |
| 3,940,782 | 2/1976 | Neeb et al. | 354/318 |
| 3,986,191 | 10/1976 | Ackermann et al. | 354/300 |
| 4,048,645 | 9/1977 | Reams | 354/300 |
| 4,166,728 | 9/1979 | Degenhardt et al. | 354/300 |

FOREIGN PATENT DOCUMENTS

| | | | |
|---|---|---|---|
| 2741326 | 3/1978 | Fed. Rep. of Germany | 354/300 |

*Primary Examiner*—L. T. Hix
*Assistant Examiner*—Alan Mathews
*Attorney, Agent, or Firm*—Samuelson & Jacob

[57] ABSTRACT

Diazotype developing apparatus and method in which a gaseous developing medium, such as a mixture of ammonia and air of predetermined concentration, is contained within a containing system, which includes the developing chamber of the apparatus, and the volume of the containing system is variable with only negligible changes in the pressure within the containing system so as to allow the volume of gaseous developing medium to be maintained within the containing system at essentially the same pressure as the pressure of the surrounding ambient atmosphere during variations in the volume of gaseous developing medium within the containing system resulting from operation of the apparatus.

11 Claims, 4 Drawing Figures

VARIABLE VOLUME DIAZOTYPE DEVELOPING APPARATUS AND METHOD

The present invention relates generally to diazotype developing apparatus and method and pertains, more specifically, to improvements in the developing of exposed diazotype copy materials utilizing a gaseous developing medium, such as ammonia.

Practically all diazotype reproduction materials require exposure to ultra-violet light to establish a latent image and a humid, alkaline environment to develop the image. The developing process in most current diazotype copy machines uses one of the following basic developing materials for providing the necessary humid, alkaline environment: anhydrous ammonia, which essentially is pure ammonia gas; aqueous ammonia, which is ammonia gas absorbed in water; or amines, which are highly alkaline ammonia-like substances.

The equipment employed in anhydrous development is generally designed for high production rates and, due to the necessity of handling high pressure cylinders of ammonia gas, is usually bulky and expensive. The developing system ordinarily consists of a large heated chamber through which the exposed copy is carried by belts or rollers. The anhydrous ammonia is metered into the chamber and, because the gas is dry, water also usually is introduced. The ammonia atmosphere is then circulated through the chamber with any excess escaping from the openings provided for the passage of the copy, the excess usually being exhausted to the atmosphere outside the room containing the machine or being neutralized by an absorber.

The amine development system, such as described in U.S. Pat. Nos. 3,704,662 and 3,940,782, is noteworthy due to the complete lack of ammonia odor associated with the machine or the copy of the system. The disadvantages to that type of developing process include: limitation as to the type of reproduction materials useable; a reduction in the copy quality during storage, due to residual chemicals in the copy; reduction in initial copy quality; and the relative high cost of the developing substances.

The equipment used for aqueous ammonia development generally falls into two categories. One aqueous ammonia developing system introduces the aqueous ammonia directly into the developing chamber where the aqueous ammonia is heated, causing moist ammonia vapors to be released into the chamber. Of course, as the aqueous ammonia is heated, and the ammonia gas is released in the chamber, with the volume of the chamber being constant, the pressure will rise, forcing ammonia vapors to escape from the chamber. The other aqueous ammonia developing system involves recirculating the ammonia vapors from an aqueous ammonia container through conduits to the developing chamber and back to the ammonia container. In such a recirculating or "closed loop" system, the amount of ammonia vapor which escapes from the developing chamber is less than in either the anhydrous system or in the directly injected aqueous system.

The present invention is concerned with limiting even further the escape of ammonia vapors from the developing chamber and related developing medium containing elements of the recirculating system, but also is suitable for use with the direct injection aqueous system. The very same property of ammonia which makes ammonia the preferred choice as a developing medium for diazotype materials is the property which causes the greatest objection to persons who must work with it; that is, at normal room temperatures and pressures, ammonia is a gas or, if combined with water vapor present in the air, a vapor which acts like a gas. The ammonia molecule is extremely active and disperses rapidly in air. In the developing process, ammonia rapidly penetrates the copy paper, neutralizes stabilizing acids in the paper and provides the highly alkaline environment which allows the chemical compounds on the paper to form the copy image. The ammonia then rapidly disperses from the copy paper leaving a completely dry copy, free from any residual developing substances. It is this highly volatile property that makes it difficult to keep the ammonia contained within the developing chamber and related elements of the containing system and, once the ammonia has escaped to the atmosphere, makes it difficult to capture the escaped ammonia with an exhaust system.

In a closed loop or direct injection system, the concentration of ammonia vapors in the system can be found or calculated from available data concerning ammonia. Typical concentrations are as follows: For 26° Baume aqueous ammonia at 68° F., the ammonia vapor concentration would be 51%. For 26° Baume aqueous ammonia at 86° F., the ammonia vapor concentration would be 80%. For 21° Baume ammonia at 68° F., the ammonia vapor concentration would be 28.3%. For 21° Baume ammonia at 86° F., the ammonia vapor concentration would be 45%. Of course, the assumption is made in the above examples that the systems are at equilibrium. However, the system seldom is at equilibrium during actual use. Many conditions can disturb the equilibrium of the system, such as, the introduction of fresh ammonia, the addition of heat, the introduction of copy materials to be developed, and the exhaustion of ammonia through the development of copy, as well as other conditions. In all of these and other instances, whenever there is a change in ammonia concentration, there will be an associated volume or pressure change. Since most developer apparatus are not pressure-tight, as there must be some means for getting the material to be developed into and out of the developer, there can be no significant pressure change associated with a change in ammonia concentration. Since there can be no appreciable pressure change of the developing medium within the containing system, there must be a change in volume. For a containing system with a fixed capacity (volume), an increase in the volume of the gases within the fixed volume system means that some of the gases (ammonia and air) will leak out of the containing system. Some typical examples would be:

A developer containing system of 0.5 cubic foot volume is empty (filled only with air). A jug of 26° Baume (28%) ammonia is attached and the vapors and air in the system are circulated to bring the system to equilibrium. From the above concentration examples it can be seen that the equilibrium concentration of the ammonia vapor at 26° Baume and 68° F. is 51%, that is, about 0.5 cubic foot of ammonia will be released from the aqueous ammonia to mix with the 0.5 cubic foot of air to form about a 50% concentration of ammonia. Since now there is 1.0 cubic foot of ammonia-air mixture to fit within a 0.5 cubic foot containing system, 0.5 cubic foot of the mixture must leak out of the system.

A developer containing system of 0.5 cubic foot capacity filled with ammonia vapor from a source of 26° Baume at 68° F. at equilibrium at 51% ammonia would go to 80% concentration if the ammonia were heated to 86° F. As before, without a leak the total volume necessary to achieve 80% concentration would be 1.25 cubic feet. Since the system volume is fixed at 0.5 cubic foot, 0.75 cubic foot must leak from the system.

If a containing system is at equilibrium at any ammonia concentration and copy materials are introduced into the system for development, the following changes will take place in the system: Ammonia will react with the acid stabilizer in the copy material, thereby lowering the ammonia concentration in the system. A lowered concentration means a lowered volume, therefore outside air will be drawn into the system to make up the lost volume, and will mix with the developing medium in the system, thereby further lowering the concentration in the system. The ammonia concentration now will be lower than the strength of the aqueous ammonia requires for equilibrium. Therefore, ammonia will be released from the aqueous ammonia to bring the ammonia concentration back to the original equilibrium point. As before, the volume of ammonia gas within the fixed system volume will increase, therefore the excess volume of ammonia gas will escape from the system.

It is an object of the present invention to reduce and even eliminate essentially the escape of gaseous developing medium from the developing medium containing system of a diazotype developing apparatus.

Another object of the invention is to provide apparatus and method by which leakage into or out of the developing medium containing system of a diazotype developing apparatus of the type employing a gaseous developing medium is substantially reduced or essentially eliminated.

Still another object of the invention is to provide apparatus and method of the type described and in which the concentration of the gaseous developing medium tends to be maintained at a predetermined concentration during operation of the apparatus.

A further object of the invention is to provide apparatus and method of the type described and in which variations in the volume of the developing medium containing system can take place with only negligible changes in the pressure within the developing medium containing system, during operation of the apparatus, in order to tend to maintain a predetermined concentration in the developing medium without leakage between the developing medium containing system and the surrounding atmosphere.

A still further object of the invention is to provide apparatus and method of the type described and which is adapted readily for use in connection with currently available diazotype reproduction apparatus and methods, thereby requiring minimal changes with a concomitant minimal added expense in the cost of manufacture.

The above objects, as well as still further objects of the invention, are attained by the present invention which may be described briefly as providing, in a diazotype developing apparatus in which a gaseous developing medium of predetermined concentration is supplied to a containing system within which the gaseous developing medium is to be isolated from the surrounding ambient atmosphere, the containing system including a developing chamber, the improvement comprising variable volume means for enabling the volume of the containing system to be varied with only negligible changes in the pressure within the containing system so as to allow the volume of gaseous developing medium of predetermined concentration to be maintained within the containing system at essentially the same pressure as the pressure of the surrounding ambient atmosphere during variations in the volume of gaseous developing medium within the containing system resulting from operation of the apparatus.

The invention further contemplates the method of minimizing the interchange between a gaseous developing medium, such as a mixture of ammonia and air of predetermined concentration, contained within a containing system which includes a developing chamber of a diazotype developing apparatus, and the air in the ambient atmosphere surrounding the containing system due to any leakage during operation of the apparatus, the method comprising the step of varying the volume of the containing system with only negligible changes in the pressure within the containing system so as to allow the volume of gaseous developing medium of predetermined concentration to be maintained within the containing system at essentially the same pressure as the pressure of the surrounding ambient atmosphere during variations in the volume of gaseous developing medium within the containing system resulting from operation of the apparatus.

The invention will be more fully understood, while still further objects and advantages will become apparent, in the following detailed description of preferred embodiments of the invention illustrated in the accompanying drawing, in which.

Figure 1:
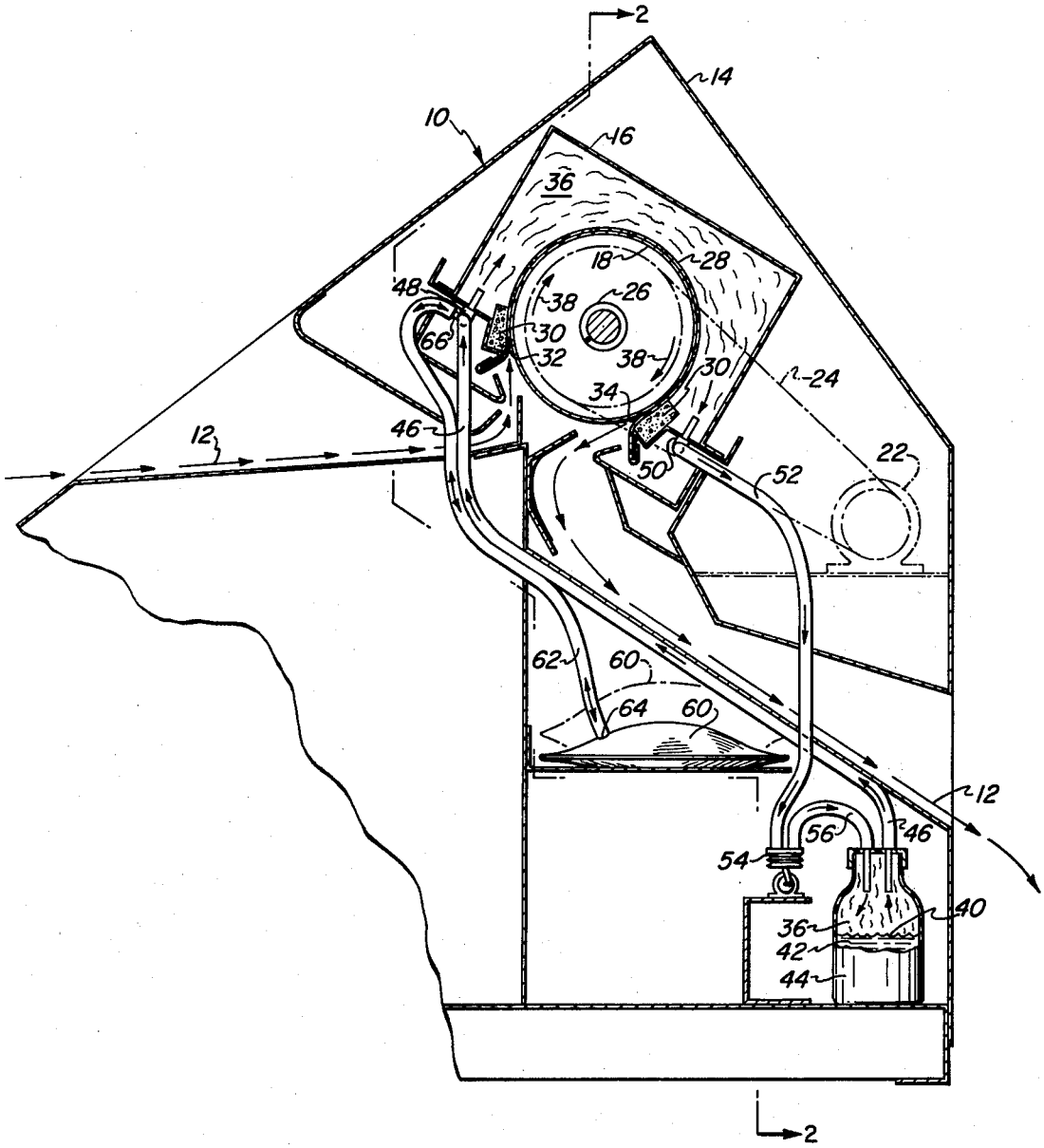
FIG. 1 is an end elevational cross-sectional view of an apparatus constructed in accordance with the invention.
Figure 2:
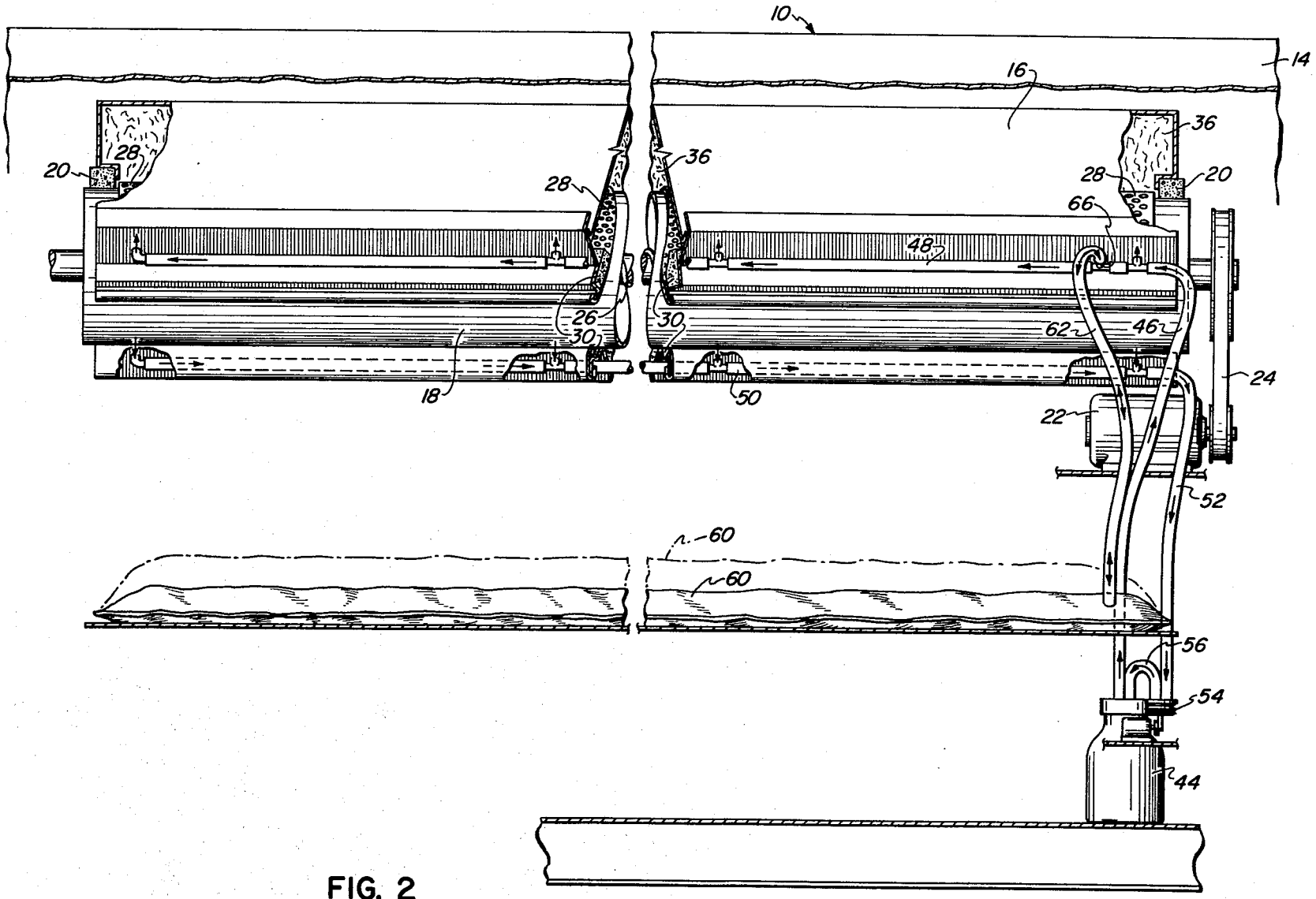
FIG. 2 is a fragmentary front elevational cross-sectional view taken along line 2—2 of FIG. 1.

Referring now to the drawing, and especially to FIGS. 1 and 2 thereof, a diazotype developing apparatus constructed for operation in accordance with the method of the invention is illustrated, largely diagrammatically, at 10 for developing exposed diazotype sheet material which follows a path of travel 12 through apparatus 10. Apparatus 10 includes a housing 14 within which the major working components of the apparatus are mounted.

The developer arrangement of apparatus 10 has a developing medium containing system which includes a chamber 16 within which there is located a hollow metal cylindrical roller 18 extending longitudinally between end seals 20 and journalled for rotation by a motor 22 and drive belt 24. Roller 18 is heated by an electrical heating device 26 which extends along the length of the roller 18 inside the roller 18. A perforated slipscreen 28 extends around the major portion of the periphery of the roller 18, and a pair of longitudinal seals 30 seal the chamber 16 at an inlet entrance 32 and an outlet exit 34 along the path of travel 12.

Chamber 16 is filled with a gaseous developing medium 36, which, in this instance, is a mixture of ammonia gas and air. The slipscreen 28 is constructed of a thin, flexible material having a very low coefficient of friction and being chemically resistant to the developing medium 36. As diazotype sheet material travels along path 12 between entrance 32 and exit 34, driven by the roller 18 which rotates in the clockwise direction, as indicated by the arrows 38 in FIG. 1, the sheet material is exposed to the developing medium 36 through the perforations in the slipscreen 28, and the sheet material is developed.

The ammonia gas and air mixture which constitutes the developing medium 36 is supplied from a reservoir 40 of aqueous ammonia 42 contained within a bottle 44. Ammonia vapor from the aqueous ammonia 42 accumulates within the bottle 44 above the aqueous ammonia 42 and enters a supply conduit, in the form of tube 46 which is connected to an inlet manifold 48 extending along the length of the chamber 16 and communicating with the interior of the chamber 16 adjacent the entrance 32. An outlet manifold 50 also extends along the length of chamber 16 and communicates with the chamber 16 adjacent the exit 34. A return conduit in the form of tube 52 interconnects the outlet manifold 50 with a bellows pump 54 which draws the developing medium from chamber 16 and returns the developing medium to the bottle 44, through extension return tube 56. The developing medium thus is circulated continuously through tube 46 and inlet manifold 48 to enter the chamber 16, and through the outlet manifold 50 and tubes 52 and 56 to leave the chamber 16.

It will be seen that variations in pressure within the developing medium containing system, and especially within chamber 16, can give rise to leakage at the end seals 20 or at longitudinal seals 30. A pressure greater than atmospheric pressure will induce leakage of ammonia vapor from the containing system to the atmosphere surrounding the chamber 16, thereby contaminating the ambient atmosphere in the vicinity of apparatus 10 with ammonia gas. A pressure less than atmospheric pressure will tend to draw ambient air from the surrounding atmosphere into the containing system, thereby diluting the concentration of ammonia gas in the ammonia gas and air mixture within the chamber 16. In order to reduce to a minimum and even tend to eliminate such leakage, the developing medium containing system is provided with means enabling the volume of the containing system to vary with negligible changes in the pressure within the containing system so as to allow the volume of the ammonia gas and air mixture of predetermined concentration to be maintained within the containing system at essentially the same pressure as the pressure of the surrounding ambient atmosphere during variations in the volume of the gaseous developing medium within the containing system resulting from the operation of apparatus 10.

Thus, the internal volume of chamber 16 is supplemented by the volume of an auxiliary accumulator chamber 60 which communicates with chamber 16 through an auxiliary tube 62 connected between inlet manifold 48 and the accumulator chamber 60. Accumulator chamber 60 is constructed so as to enable the volume provided by the chamber 60 to change from virtually zero volume to full capacity with essentially no increase in pressure. In the illustrated example, the desired characteristic is attained by employing a highly flexible material in the wall construction of chamber 60. The material is fabricated into a bag-like shape which is completely sealed, except for the connection at 64 to tube 62. The material is chosen from those materials which are chemically resistant to ammonia gas and which are physically impervious to the gas. A variety of suitable synthetic resin materials are available. As an example, a bag constructed of polyethylene having a wall thickness of about 0.004 inch requires an internal pressure of about 0.00055 inches of mercury (0.00027 psi) to begin expanding in volume. Since atmospheric pressure measures approximately 30 inches of mercury, it is obvious that the pressure required to expand or contract the volume provided within such a bag is so low as to be negligible. Hence, by constructing auxiliary accumulator chamber 60 in the form of a flimsy-walled bag, the chamber 60 can be expanded or contracted to provide variations in volume while the pressure within the chambers 16 and 60 remains essentially unchanged.

Auxiliary accumulator chamber 60 can be fabricated in practically any reasonable shape and size, with the volumetric capacity limited mainly by the space available in or around the apparatus 10. As a practical matter, however, chamber 60 is sized to accommodate a given percentage of the volume of the fixed volume portion of the containing system, as established by chamber 16 and the interconnected tubes, manifolds and reservoir which constitute the remainder of the containing system. With reference to the examples provided above, if the fixed volume portion of the containing system is 0.5 cubic foot and the system is charged with 26° Baume ammonia at 68° F., the system will be required to accommodate 1.0 cubic foot of ammonia and air mixture in order to prevent leakage from the system. Therefore, the accumulator chamber 60 must be at least of the same volumetric capacity as the fixed volume portion of the containing system. Should the containing system be subjected to temperature changes, a larger capacity accumulator chamber would be advantageous. It should be noted that an accumulator chamber could be too small to be effective, but once the optimum capacity is determined, further increases in volumetric capacity would not result in less leakage from the system and would not be deleterious. It has been determined that the optimum location of the connection of tube 62 to the fixed volume portion of the containing system is close to chamber 16 and at the location where the ammonia gas concentration is the greatest, i.e., at a connection anywhere along inlet manifold 48, such as at 66. In this manner, changes in volume provided by the expansion or contraction of accumulator chamber 60 will be more quickly responsive to changes in the concentration of ammonia gas in the mixture supplied to the chamber 16.

Figure 3:
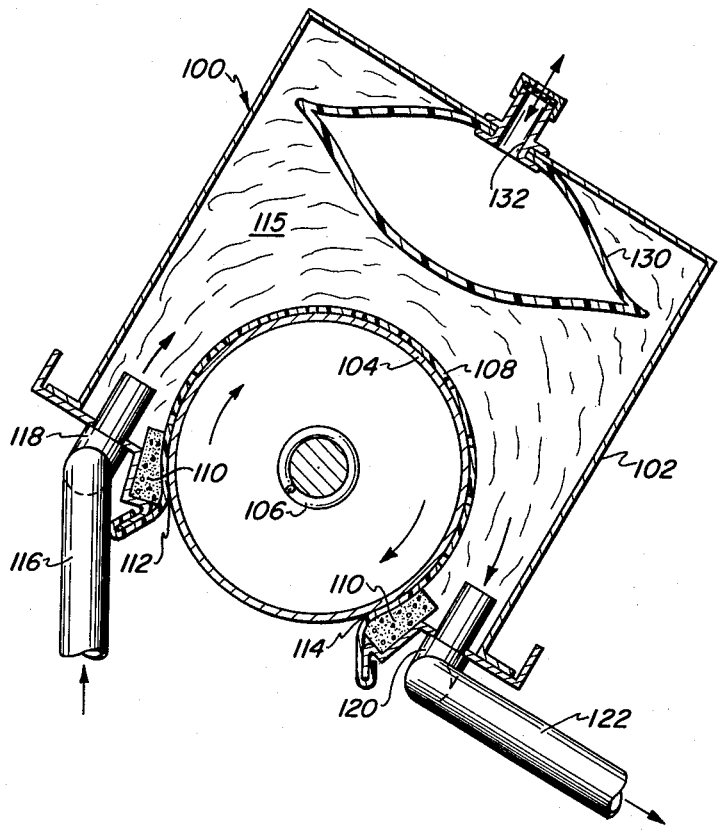
FIG. 3 is a fragmentary cross-sectional view similar to FIG. 1, but showing another apparatus constructed in accordance with the invention.

Turning now to FIG. 3, another arrangement is illustrated for providing variable volume means in the developing medium containing system of a diazotype developing apparatus. Apparatus 100 includes a developing chamber 102 within which a cylindrical roller 104, heated by a heater 106, rotates to pass a sheet of diazotype material (not shown) between the outer surface of the roller 104 and a perforated slipscreen 108. Longitudinal seals 110 are provided at an entrance 112 and an exit 114.

Developing medium 115 is supplied through an inlet tube 116 and an inlet manifold 118 to chamber 102 and exits through an outlet manifold 120 and tube 122 to be recirculated through the developing medium containing system as described in connection with the earlier-described embodiment. The internal volume of chamber 102 may be varied with negligible changes in pressure within the developing medium containing system by virtue of a flimsy-walled bag 130 located within the chamber 102 and having a port 132 vented to the ambient atmosphere. Air may be drawn into the bag 130 through port 132 to inflate the bag 130 or may be expelled from the bag 130 to deflate the bag to establish the appropriate volume within the chamber 102. In the arrangement illustrated in FIG. 3, the variable volume provided by the bag 130 is limited by the placement of the bag within the chamber 102.

Figure 4:
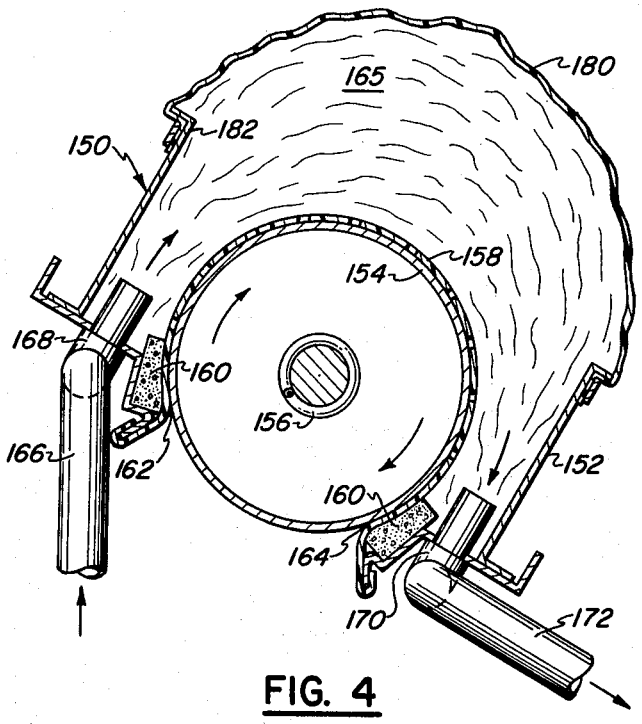
FIG. 4 is a fragmentary cross-sectional view similar to FIG. 1, but showing still another apparatus constructed in accordance with the invention.

In the embodiment illustrated in FIG. 4, apparatus 150 includes a developing chamber 152 within which a cylindrical roller 154, heated by a heater 156, rotates to pass a sheet of diazotype material (not shown) between the outer surface of the roller 154 and a perforated slipscreen 158. Longitudinal seals 160 are provided at an entrance 162 and an exit 164.

Developing medium 165 is supplied through an inlet tube 166 and an inlet manifold 168 to chamber 152 and exits through an outlet manifold 170 and tube 172 to be recirculated within the developing medium containing system as described in connection with apparatus 10. The internal volume of chamber 152 may be varied with negligible changes in pressure within the developing medium containing system by virtue of a flimsy wall portion 180 of the wall 182 of chamber 152. The material of flimsy wall portion 180 is the same highly flexible material utilized for the bags described in connection with apparatus 10 and apparatus 100. In the arrangement illustrated in FIG. 4, the volume of chamber 152 is variable from virtually zero volume to any chosen maximum. A practical minimum limit is placed on the volume to prevent complete collapse of the wall portion 180.

It will be apparent that the variable volume developing medium containing systems described above substantially reduce the leakage of gaseous developing medium from the systems, and, in particular, leakage associated with initial start-up, leakage associated with the introduction of diazotype sheet materials for developing, and leakage induced by heating of the developing medium supply. In addition, by substantially reducing the amount of outside air drawn into the developing medium containing system during use, the concentration of the developing medium is maintained at the maximum predetermined strength—a considerable advantage during the developing of large or long copies. With a fixed volume developing medium containing system, air is drawn into the system, thereby weakening the concentration of the developing medium and causing the quality of the developed copy to diminish over the length of the copy. With a variable volume system, instead of air being drawn from the outside, the volume of the developing medium containing system merely decreases while the concentration of the developing medium remains undiluted.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. In a diazotype developing apparatus in which a gaseous developing medium of predetermined concentration is supplied to a containing system within which the gaseous developing medium is to be isolated from the surrounding ambient atmosphere, the containing system including a developing chamber, the improvement comprising variable volume means for enabling the volume of the containing system to be varied with only negligible changes in the pressure within the containing system so as to allow the volume of gaseous developing medium of predetermined concentration to be maintained within the containing system at essentially the same pressure as the pressure of the surrounding ambient atmosphere during variations in the volume of gaseous developing medium within the containing system resulting from operation of the apparatus.

2. The invention of claim 1 wherein the variable volume means includes an accumulator chamber of variable volume located externally of the developing chamber and communicating with the developing chamber.

3. The invention of claim 2 wherein the accumulator chamber comprises a flimsy-walled bag capable of inflation and deflation with negligible changes in pressure within the bag.

4. The invention of claim 3 wherein the flimsy-walled bag includes a wall of relatively thin synthetic resin material which is generally chemically resistant and physically impervious to the gaseous developing material.

5. The invention of claim 1 wherein the developing chamber includes a wall defining the volume of the developing chamber and the variable volume means includes a flimsy portion of said developing chamber wall.

6. The invention of claim 5 wherein the flimsy portion is a relatively thin wall portion constructed of a synthetic resin material which is generally chemically resistant and physically impervious to the gaseous developing medium.

7. The invention of claim 1 wherein the variable volume means includes an auxiliary chamber of variable volume located within the developing chamber and communicating with the ambient atmosphere.

8. The invention of claim 7 wherein the auxiliary chamber comprises a flimsy-walled bag capable of inflation and deflation with negligible changes in the pressure surrounding the bag.

9. The invention of claim 8 wherein the flimsy-walled bag includes a wall of relatively thin synthetic resin material which is generally chemically resistant and physically impervious to the gaseous developing material.

10. The invention of claim 1, 2, 3, 4, 5, 6, 7, 8 or 9 wherein the gaseous developing medium includes ammonia.

11. The method of minimizing the interchange between a gaseous developing medium of predetermined concentration contained within a containing system, which includes a developing chamber of a diazotype developing apparatus, and the air in the ambient atmosphere surrounding the containing system, due to any leakage during operation of the apparatus, said method comprising the steps of:

operating the developing apparatus in such a way as to cause variations in the volume of gaseous developing medium within the containing system; and varying the volume of the containing system with only negligible changes in the pressure within the containing system so as to allow the volume of gaseous developing medium of predetermined concentration to be maintained within the containing system at essentially the same pressure as the pressure of the surrounding ambient atmosphere during said variations in the volume of gaseous developing medium within the containing system.

* * * * *